US006000820A

United States Patent [19]

Murray

[11] Patent Number: 6,000,820

[45] Date of Patent: Dec. 14, 1999

[54] LOW VOLTAGE LIGHT NOVELTY DECORATIONS

[76] Inventor: Kenneth J. Murray, 42 Woodmere Pl., Selden, N.Y. 11784

[21] Appl. No.: 09/086,685

[22] Filed: May 28, 1998

[51] Int. Cl.[6] ..... F21V 17/00

[52] U.S. Cl. ..... 362/441; 362/124; 362/255; 362/351; 362/457; 362/808

[58] Field of Search ..... 362/363, 124, 362/186, 351, 375, 255, 441, 457, 808, 806, 154, 122, 190, 191; 220/319, 376

[56] References Cited

U.S. PATENT DOCUMENTS

| | | | |
|---|---|---|---|
| 1,349,374 | 8/1920 | Gruenfeld, Jr. | 362/124 |
| 2,059,653 | 11/1936 | Pretzfelder | 41/10 |
| 2,339,385 | 1/1944 | Dupler | 362/363 |
| 2,465,700 | 3/1949 | Tuttle | 240/10 |
| 2,590,279 | 3/1952 | Soss | 272/8 |
| 2,749,432 | 6/1956 | Dorsey | 240/10 |
| 4,714,984 | 12/1987 | Spector | 362/101 |
| 5,105,343 | 4/1992 | Wakimoto | 362/101 |
| 5,274,537 | 12/1993 | Altman | 362/353 |
| 5,309,333 | 5/1994 | Kandampully | 362/121 |
| 5,526,243 | 6/1996 | Masters | 362/122 |
| 5,537,297 | 7/1996 | Ghandehari | 362/32 |

*Primary Examiner*—Cassandra Spyrou
*Assistant Examiner*—Leo Boutsikaris
*Attorney, Agent, or Firm*—Richard L. Miller, P.E.

[57] ABSTRACT

A low voltage light novelty decoration that includes a substantially hollow and decorative main portion, a generally circular-shaped base portion, and adjusting apparatus. The substantially hollow and decorative main portion has a shape that identifies a specific event and provides an optical recognition that associates the specific event in a mind of a viewer. The generally circular-shaped base portion is integrally formed and has an exposed outer surface, a substantially concealed inner surface, a center, and a centrally-disposed, inwardly-tapering, longitudinally-oriented, and generally circular-shaped throughbore. And, the adjusting apparatus is associated with the generally circular-shaped base portion for adjusting the diameter of the centrally-disposed, inwardly-tapering, longitudinally-oriented, and generally circular-shaped throughbore to substantially equal the diameter of the light portion if the diameter of the centrally-disposed, inwardly-tapering, longitudinally-oriented, and generally circular-shaped throughbore is not substantially equal to the diameter of the light portion, so that the centrally-disposed, inwardly-tapering, longitudinally-oriented, and generally circular-shaped throughbore can be adjusted by the adjusting apparatus to properly fit on the light portion when the top cap of the light portion is removed and replaced by the voltage light novelty decoration.

9 Claims, 1 Drawing Sheet

10
14
16
26
13
15
12

10
14
20, 120
16
28, 128
15
12

16
22
26
28
20
18
3
3

14
26
24
16
22
28
20

122
132
126
128
120
118
116
5
5
130

14
126
124
116
122
128
120

LOW VOLTAGE LIGHT NOVELTY DECORATIONS

CROSS REFERENCE TO RELATED APPLICATIONS

The instant application is a related to application Ser. No. 08/654,323, filed on May 28, 1996, and now abandoned.

BACKGROUND OF THE INVENTION

The present invention relates to a light decoration. More particularly, the present invention relates to a low voltage light novelty decoration that includes a substantially hollow and decorative main portion with a shape that identifies a specific event and provides an optical recognition that associates the specific event in a mind of a viewer, a generally circular-shaped base portion that has a centrally-disposed, inwardly-tapering, longitudinally-oriented, and generally circular-shaped throughbore, and adjusting apparatus that is associated with the generally circular-shaped base portion for adjusting the diameter of the centrally-disposed, inwardly-tapering, longitudinally-oriented, and generally circular-shaped throughbore to substantially equal the diameter of the light portion if the of the centrally-disposed, inwardly-tapering, longitudinally-oriented, and generally circular-shaped throughbore is not substantially equal to the diameter of the light portion.

People love to decorate for various holidays. This is done primarily using 110/120 volt lighting fixtures which are expensive to operate and potentially dangerous.

As is known, it is customary to in-line walks, driveways, or the like with illuminated makers, such typically being low to the ground, operate on low voltage, and include a shade-cover for light diffusion. The preceding units come in various sizes, typically being placed through staking action, with an electrical cord passing between successive units and to a power source.

Numerous innovations for decorative lights have been provided in the prior art that will be described. However, even though these innovations may be suitable for the specific individual purposes to which they address, they differ from the present invention in that they do not teach a low voltage light novelty decoration that includes a substantially hollow and decorative main portion with a shape that identifies a specific event and provides an optical recognition that associates the specific event in a mind of a viewer, a generally circular-shaped base portion that has a centrally-disposed, inwardly-tapering, longitudinally-oriented, and generally circular-shaped throughbore, and adjusting apparatus that is associated with the generally circular-shaped base portion for adjusting the diameter of the centrally-disposed, inwardly-tapering, longitudinally-oriented, and generally circular-shaped throughbore to substantially equal the diameter of the light portion if the diameter of the centrally-disposed, inwardly-tapering, longitudinally-oriented, and generally circular-shaped throughbore is not substantially equal to the diameter of the light portion.

FOR EXAMPLE, U.S. Pat. No. 1,349,374 to Gruenfeld, Jr. teaches a device of the character described comprising an electric lamp socket, a lamp therefor having a screw threaded plug adapted to fit the socket, and an ornament carrier having an ornament supporting ring and an insulating plate contained within the ring, the plate having a screw threaded opening adapted to be engaged by the plug to thereby support the carrier on the lamp.

ANOTHER EXAMPLE, U.S. Pat. No. 2,059,653 to Pretzfelder teaches as an article of manufacture, a reflector ornament adapted for use in the decoration of a Christmas tree, comprising a plurality of substantially conical sections joined together at their lower extremities to form a unitary body, means for securing the unitary body to a Christmas tree in upright position, and an annular disc secured centrally of the rear face of the ornament and having a plurality of spring fingers extending into the body of the ornament and securing an electric light bulb within the body of the ornament.

STILL ANOTHER EXAMPLE, U.S. Pat. No. 2,339,385 to Dupler teaches the combination of a glass globe having an opening therein, a tubular sleeve of plastic material fitting into the opening, an annular series of relatively narrow outwardly extending resilient ribs integral with the sleeve and frictionally engaging the edge wall of the opening, the ribs normally extending outwardly beyond the circumference of the opening and being compressed during application of the sleeve to the globe, each rib being of gradually increasing thickness with the thinner end at the inner end portion of the sleeve.

YET ANOTHER EXAMPLE, U.S. Pat. No. 2,465,700 to Tuttle teaches an ornamental lighting fixture comprising a body having an electric lamp socket mounted centrally thereon and a reflector surface surrounding the socket, the reflector being adapted to receive downwardly directed light from a light-transmitting ornament mounted above the socket, the body having on its upper side an outside threaded hollow boss coaxial with the socket adapted to support an inside threaded collar, and the body having on its lower side opposite the socket a cylindrical cavity within a cylindrical wall having an interrupted flange extending outwardly from the wall, with openings through the cylindrical wall adapted for the entrance and exit of a pair of side-by-side insulated electrical conductors, and sharp-pointed electrical contact members electrically connected to the socket terminals embedded in opposite positions in the wall with the points directed inwardly and adapted to penetrate the insulation to make electrical contact with the conductors; a threaded collar attachable to the boss, the upper end of the collar being arranged for removably attaching a light-transmitting ornament; and a closure member for the cylindrical cavity in the holder, including a cam member extending into the cavity between the side-by-side conductors and adapted upon rotation to press each of the conductors into contact with one of the pointed members, and flange-engaging lips arranged to pass through the gaps in the flange and upon rotation of the closure adapted to frictionally engage the flange; and spring clamp means attached to the closure member for removably attaching the fixture to a Christmas tree or the like.

STILL YET ANOTHER EXAMPLE, U.S. Pat. No. 2,590,279 to Soss teaches a toy comprising a transparent tube, a volatile liquid, means for maintaining the liquid at a level in the tube, an image within the tube and adapted to float upon the liquid, a heater for causing the liquid to bubble, whereby the image is caused to bob, and means for heating the heater.

YET STILL ANOTHER EXAMPLE, U.S. Pat. No. 2,749,432 to Dorsey teaches an illuminated unit comprising in combination, an incandescent lamp having a glass bulb of substantially ovoidal shape and a base secured to the larger end of the bulb, a body of light transmitting material shaped to receive the lamp bulb and a collar support the body around the lamp bulb, the wall of the larger end portion of the bulb being irregular, the irregular portion of the wall extending circumferentially of the bulb at a region closely adjacent the base thereon and comprising a recess which is annularly discontinuous around the bulb to provide transversely facing locking shoulders thereon, the irregular wall portion providing a seat for the collar around the end portion of the bulb, the collar having spaced spring fingers extending inwardly from a solid ring and engaging the irregular wall portion of the bulb and within the recess thereof to lock the collar in place on the bulb against both rotative and axial movement relative thereto, the body being attached to the solid ring part of the collar whereby the light transmitting body is supported by the lamp bulb.

STILL YET ANOTHER EXAMPLE, U.S. Pat. No. 4,714,984 to Spector teaches a night light assembly which plugs into and is supported by an electrical wall outlet whose orientation on the wall is either horizontal or vertical. The assembly, which switched on, produces low-level illumination and at the same time exudes an aromatic vapor. The assembly includes a reflector shell having housed therein a low-wattage bulb. Attached to the open front of the shell is a frame adapted to accommodate a removable window cartridge having a transparent plate whose rear face is covered by a thin pad of light-permeable porous material impregnated with a volatile aromatic liquid. The shell is vented, and as the air therein is heated and expanded by heat emanating from the bulb, a convection current is produced which flows across the pad to volatilize the liquid, thereby creating an aromatic vapor that is discharged through the vent. Adherable to the front face of the window plate is a translucent sheet having a picture thereon of an object possessing a characteristic odor, the fragrance of the aromatic vapor being thematically related thereto. The sheet is so adhered to the plate as to orient the picture thereon to conform to the existing orientation of the outlet into which the assembly is plugged.

YET STILL ANOTHER EXAMPLE, U.S. Pat. No. 5,105,343 to Wakimoto teaches a decorative illuminating torch that, by reflecting and refracting light emitted to the side and rear of a light source through transparent thread members and down the length of a grip portion, the grip portion is illuminated. The light emitted from the front of the light source can be used to illuminate further novelty items.

STILL YET ANOTHER EXAMPLE, U.S. Pat. No. 5,274,537 to Altman teaches a decorative lighting arrangement utilizing a standard commercial illuminated marker, such as one which outlines a walk, a driveway or the like. Importantly, the invention provides a substitute decorative component or structure which serves to replace the shade-cover typically found on the presently available marker. In other words, and through, for example, rotating action, the decorative component serves to present a holiday or special occasion motif through the use of and by modifying an existing light providing marker. The end effects of the invention are manyfold, serving to satisfy a variety of festive occasions.

YET STILL ANOTHER EXAMPLE, U.S. Pat. No. 5,309,333 to Kandampully teaches a light emitting foldable decoration is provided for a socket holder fixture with a light bulb suspended by a power cord from a mounting plate on a ceiling of a building. The decoration consists of a structure connected to the socket holder fixture for screening the light bulb and another structure for covering the screening structure, so that the covering structure will allow some of the light illuminating from the light bulb to enhance the appearance of the covering surface.

STILL YET ANOTHER EXAMPLE, U.S. Pat. No. 5,526,243 to Masters teaches a decorative enclosure or cover is adjustably fitted over a low voltage light fixture. The light fixture is of the type that has a stake adapted to be partially inserted into the ground, a support extending upwardly from the stake, a light bulb assembly mounted atop the support, a light cover positioned over the light bulb assembly and a power source connected to the bulb assembly for supplying electricity to the same. The light cover includes a sleeve that extends downwardly from the bottom thereof. The sleeve is slidable along the support and has at least one opening formed therethrough. A screw is threaded through the opening in the sleeve wall in order to engage the support and maintain the enclosure in place.

FINALLY, YET STILL ANOTHER EXAMPLE, U.S. Pat. No. 5,537,297 to Ghandehari teaches an apparatus is provided for reflecting light, and includes a transparent tube having two end surfaces and a cylindrical side wall. A light source includes both an illuminating light beam and a tube holding member that holds at least one of the end surfaces close to the light source so that the light beam propagates through at least one of the end surfaces and then along the tube. A color light filter may be positioned between the light source and at least one end surface of the tube so that the color of the light beam is selectable. At least one opaque thin film strip is adhered to or etched into a minor portion of the circumference of the outer surface for reflecting a portion of the light beam transversely through the tube such that the portion of the light beam is visible along the side wall of the tube.

It is apparent that numerous innovations for decorative lights have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a low voltage light novelty decoration that avoids the disadvantages of the prior art.

ANOTHER OBJECT of the present invention is to provide a low voltage light novelty decoration that is simple and inexpensive to manufacture.

STILL ANOTHER OBJECT of the present invention is to provide a low voltage light novelty decoration that is simple and easy to use.

YET ANOTHER OBJECT of the present invention is to provide a low voltage light novelty decoration that utilizes low voltage walkway/driveway light fixtures as the light source for the novelty decoration.

STILL YET ANOTHER OBJECT of the present invention is to provide a low voltage light novelty decoration that reduces electrical costs and reduce the danger of electrical shock.

BRIEFLY STATED YET STILL ANOTHER OBJECT of the present invention is to provide a low voltage light novelty decoration that is installable on a conventional low voltage light fixture that has a light portion with a diameter, a shape, and a removable top cap that includes a substantially hollow and decorative main portion, a generally circular-shaped base portion, and adjusting apparatus.

STILL YET ANOTHER OBJECT of the present invention is to provide a low voltage light novelty decoration wherein the substantially hollow and decorative main portion has a shape, so that the shape of the substantially hollow and decorative main portion identifies a specific event and provides an optical recognition that associates the specific event in a mind of a viewer.

YET STILL ANOTHER OBJECT of the present invention is to provide a low voltage light novelty decoration wherein the generally circular-shaped base portion has an exposed outer surface, a substantially concealed inner surface, a center, and a centrally-disposed, inwardly-tapering, longitudinally-oriented, and generally circular-shaped throughbore that passes longitudinally through the center of the generally circular-shaped base portion and which has a diameter.

STILL YET ANOTHER OBJECT of the present invention is to provide a low voltage light novelty decoration wherein the generally circular-shaped base portion is integrally formed with the substantially hollow and decorative main portion.

YET STILL ANOTHER OBJECT of the present invention is to provide a low voltage light novelty decoration wherein the adjusting apparatus is associated with the generally circular-shaped base portion for adjusting the diameter of the centrally-disposed, inwardly-tapering, longitudinally-oriented, and generally circular-shaped throughbore of the generally circular-shaped base portion to substantially equal the diameter of the light portion of the conventional low voltage light fixture if the diameter of the centrally-disposed, inwardly-tapering, longitudinally-oriented, and generally circular-shaped throughbore of the generally circular-shaped base portion is not substantially equal to the diameter of the light portion of the conventional low voltage light fixture, so that the centrally-disposed, inwardly-tapering, longitudinally-oriented, and generally circular-shaped throughbore of the generally circular-shaped base portion can be adjusted by the adjusting means of the generally circular-shaped base portion to properly fit on the light portion of the conventional low voltage light fixture when the top cap of the light portion of the conventional low voltage light fixture is removed and replaced by the voltage light novelty decoration.

STILL YET ANOTHER OBJECT of the present invention is to provide a low voltage light novelty decoration wherein the shape of the substantially hollow and decorative main portion is selected from the group consisting of an angel to identify Christmas, a snow man to identify Christmas, a candle to identify Christmas, a candy cane to identify Christmas, a star to identify Christmas, a cross to identify Christmas, a wooden soldier to identify Christmas, a Santa Claus to identify Christmas, a reindeer to identify Christmas, a sled to identify Christmas, a tree to identify Christmas, a ginger bread man to identify Christmas, a flag to identify Independence Day, a star-burst to identify Independence Day, a wounded trio to identify Independence Day, a pumpkin to identify Halloween, a ghost to identify Halloween, a witch to identify Halloween, a back cat to identify Halloween, a skull to identify Halloween, a turkey to identify Thanksgiving, an indian to identify Thanksgiving, a pilgrim to identify Thanksgiving, an ear of corn to identify Thanksgiving, a lamb to identify Easter, a duck to identify Easter, a bunny to identify Easter, a tulip to identify Easter, and a lily to identify Easter.

YET STILL ANOTHER OBJECT of the present invention is to provide a low voltage light novelty decoration wherein the shape of the substantially hollow and decorative main portion is selected from the group consisting of a car to identify a vanity item, a boat to identify a vanity item, a plane to identify a vanity item, and a motorcycle to identify a vanity item.

STILL YET ANOTHER OBJECT of the present invention is to provide a low voltage light novelty decoration wherein the shape of the substantially hollow and decorative main portion is selected from the group consisting of an attorney's book to identify an employment item, a CPA's dollar sign to identify an employment item, a mechanic's wrench to identify an employment item, a plumber's plunger to identify an employment item, an electrician's spark to identify an employment item, and an engineer's slide rule to identify an employment item.

YET STILL ANOTHER OBJECT of the present invention is to provide a low voltage light novelty decoration wherein the shape of the substantially hollow and decorative main portion is selected from the group consisting of the sign of the Elks to identify a fraternal organization, the sign of the Masons to identify a fraternal organization, the sign of the K of C to identify a fraternal organization, the sign of the American Legion to identify a fraternal organization, the sign of the Rotary to identify a fraternal organization, and the sign of the Moose to identify a fraternal organization.

STILL YET ANOTHER OBJECT of the present invention is to provide a low voltage light novelty decoration wherein the substantially hollow and decorative main portion has an internal vertical clearance space that opens into, and extends inwardly from, the centrally-disposed, inwardly-tapering, longitudinally-oriented, and generally circular-shaped throughbore of the generally circular-shaped base portion, so that the low voltage light novelty decoration is accommodated installation on the light portion of the conventional low voltage light fixture while assuring stability after installation thereof.

YET STILL ANOTHER OBJECT of the present invention is to provide a low voltage light novelty decoration wherein the adjusting means includes a plurality of snapingly-removable, co-planar, concentrically-disposed, generally circular-shaped, and continuous rings that can be snapingly removed from each other and from the generally circular-shaped base portion, are generally circular shaped, and are co-planar and which are concentric with each other and with the centrally-disposed, inwardly-tapering, longitudinally-oriented, and generally circular-shaped throughbore of the generally circular-shaped base portion.

STILL YET ANOTHER OBJECT of the present invention is to provide a low voltage light novelty decoration wherein an innermost remaining ring of the plurality of base portion snapingly-removable, co-planar, concentrically-disposed, generally circular-shaped, and continuous rings of the generally circular-shaped base portion defines the centrally-disposed, inwardly-tapering, longitudinally-oriented, and generally circular-shaped throughbore of the generally circular-shaped base portion.

YET STILL ANOTHER OBJECT of the present invention is to provide a low voltage light novelty decoration wherein the plurality of snapingly-removable, co-planar, concentrically-disposed, generally circular-shaped, and continuous rings of the generally circular-shaped base portion are formed by a plurality of V-shaped, inwardly-tapering, co-planar, concentrically-disposed, and continuous snap-off ring grooves that are co-planar and concentric with each other and with the centrally-disposed, inwardly tapering, longitudinally-oriented, and generally circular-shaped throughbore of the generally circular-shaped base portion and with the plurality of snapingly-removable, co-planar, concentrically-disposed, generally circular-shaped, and continuous rings.

STILL YET ANOTHER OBJECT of the present invention is to provide a low voltage light novelty decoration wherein the plurality of V-shaped, inwardly-tapering, co-planar, concentrically-disposed, and continuous snap-off grooves of the generally circular-shaped base portion divide the generally circular-shaped base portion into the plurality of snapingly-removable co-planar, concentrically-disposed, generally circular-shaped, and continuous rings of the generally circular-shaped base portion, and provide a vehicle for removing at least one ring of the plurality of snapingly-removable, co-planar, concentrically-disposed, generally circular-shaped, and continuous rings of the generally circular-shaped base portion from each other and from the generally circular-shaped base portion, so that at least one ring of the plurality of snapingly-removable, co-planar, concentrically-disposed, generally circular-shaped, and continuous rings of the generally circular-shaped base portion can be removed until the diameter of the centrally-disposed, inwardly-tapering, longitudinally-oriented, and generally circular-shaped throughbore of the generally circular-shaped base portion substantially equals the diameter of the light portion of the conventional low voltage light fixture.

YET STILL ANOTHER OBJECT of the present invention is to provide a low voltage light novelty decoration wherein the plurality of V-shaped, inwardly-tapering, co-planar, concentrically-disposed, and continuous snap-off ring grooves of the generally circular-shaped base portion is produced my means selected from the group consisting of imprinting and embossing.

STILL YET ANOTHER OBJECT of the present invention is to provide a low voltage light novelty decoration wherein the plurality of V-shaped, inwardly-tapering, co-planar, concentrically-disposed, and continuous snap-off grooves of the generally circular-shaped base portion taper inwardly from the exposed outer surface of the generally circular-shaped base portion toward the substantially concealed inner surface of the generally circular-shaped base portion, so that removing the at least one ring of the plurality of base portion snapingly-removable, co-planar, concentrically-disposed, generally circular-shaped, and continuous rings of the generally circular-shaped base portion from each other and from the generally circular-shaped base portion provides a chamfer on an exposed edge of the innermost remaining ring of the plurality of snapingly-removable, co-planar, concentrically-disposed, generally circular-shaped, and continuous rings of the generally circular-shaped base portion that not only facilitates guidance of the low voltage light novelty decoration onto the light portion of the conventional low voltage light fixture but also forms a point by virtue of its chamfered configuration that not only deforms to conform to the shape of the light portion of the conventional low voltage light fixture but also concentrates force exerted by the low voltage light novelty decoration onto the light portion of the conventional low voltage light fixture for increased stability when the low voltage light novelty decoration is installed thereon.

YET STILL ANOTHER OBJECT of the present invention is to provide a low voltage light novelty decoration wherein the plurality of snapingly-removable, co-planar, concentrically-disposed, generally circular-shaped, and continuous rings of the generally circular-shaped base portion are formed by a plurality of inwardly-tapering, co-planar, concentrically-disposed, and non-continuous throughslots that are co-planar and concentric with each other and with the centrally-disposed, inwardly-tapering, longitudinally-oriented, and generally circular-shaped throughbore of the generally circular-shaped base portion and with the plurality of snapingly-removable, co-planar, concentrically-disposed, generally circular-shaped, and continuous rings.

STILL YET ANOTHER OBJECT of the present invention is to provide a low voltage light novelty decoration wherein the plurality of inwardly-tapering, co-planar, concentrically-disposed, generally circular-shaped, and non-continuous throughslots of the generally circular-shaped base portion divide the generally circular-shaped base portion into the plurality of snapingly-removable, co-planar, concentrically-disposed, generally circular-shaped, and continuous rings of the generally circular-shaped base portion.

YET STILL ANOTHER OBJECT of the present invention is to provide a low voltage light novelty decoration wherein the plurality of inwardly-tapering, co-planar, concentrically-disposed, and non-continuous throughslots of the generally circular-shaped base portion taper inwardly from the exposed outer surface of the generally circular-shaped base portion toward the substantially concealed inner surface of the generally circular-shaped base portion, so that removing the at least one ring of the plurality of base portion snapingly-removable, co-planar, concentrically-disposed, generally circular-shaped, and continuous rings of the generally circular-shaped base portion from each other and from the generally circular-shaped base portion provides a chamfer on an exposed edge of the innermost remaining ring of the plurality of snapingly-removable, co-planar, concentrically-disposed, generally circular-shaped, and continuous rings of the generally circular-shaped base portion that not only facilitates guidance of the low voltage light novelty decoration onto the light portion of the conventional low voltage light fixture but also forms a point by virtue of its chamfered configuration that not only deforms to conform to the shape of the light portion of the conventional low voltage light fixture but also concentrates force exerted by the low voltage light novelty decoration onto the light portion of the conventional low voltage light fixture for increased stability when the low voltage light novelty decoration is installed thereon.

STILL YET ANOTHER OBJECT of the present invention is to provide a low voltage light novelty decoration wherein each non-continuous throughslot of the plurality of inwardly-tapering, co-planar, concentrically-disposed, and non-continuous throughslots of the generally circular-shaped base portion is divided into a plurality of arcuate-shaped throughslots by snap-off tabs which not only divide each non-continuous throughslot of the plurality of inwardly-tapering, co-planar, concentrically-disposed, and non-continuous throughslots of the generally circular-shaped base portion into the plurality of arcuate-shaped throughslots of each non-continuous throughslot of the plurality of inwardly-tapering, co-planar, concentrically-disposed, and non-continuous throughslots of the generally circular-shaped base portion, but also provide a vehicle for removing the at least one ring of the plurality of snapingly-removable, co-planar, concentrically-disposed, generally circular-shaped, and continuous rings from each other and from the generally circular-shaped base portion, so that at least one ring of the plurality of snapingly-removable, co-planar, concentrically-disposed, generally circular-shaped, and continuous rings of the generally circular-shaped base portion can be removed until the diameter of the centrally-disposed, inwardly-tapering, longitudinally-oriented, and generally circular-shaped throughbore of the generally circular-shaped base portion substantially equals the diameter of the light portion of the conventional low voltage light fixture.

YET STILL ANOTHER OBJECT of the present invention is to provide a low voltage light novelty decoration wherein the snap-off tabs of the generally circular-shaped base portion of each throughslot of the plurality of inwardly-tapering, co-planar, concentrically-disposed, generally circular-shaped, and non-continuous continuous throughslots of the generally circular-shaped base portion are staggered relative to the snap-off tabs of the generally circular-shaped base portion of an adjacent throughslot of the plurality of inwardly-tapering, co-planar, concentrically-disposed, generally circular-shaped, and non-continuous throughslots of the generally circular-shaped base portion, so that more rigidity is provided to the generally circular-shaped base portion.

STILL YET ANOTHER OBJECT of the present invention is to provide a low voltage light novelty decoration that further includes instructions for installing the low voltage light novelty decoration onto the light portion of the conventional low voltage light fixture.

YET STILL ANOTHER OBJECT of the present invention is to provide a method of installing a low voltage light novelty decoration onto a conventional low voltage light fixture that has a light portion with a diameter and a removable top cap that includes the steps of removing the removable top cap of the conventional low voltage light fixture from the light portion of the conventional low voltage light fixture, sizing a diameter of a centrally-disposed, inwardly-tapering, longitudinally-oriented, and generally circular-shaped throughbore of a generally circular-shaped base portion of the low voltage light novelty decoration to the diameter of the light portion of the conventional low voltage light fixture, determining if the diameter of the centrally-disposed, inwardly-tapering, longitudinally-oriented, and generally circular-shaped throughbore of the generally circular-shaped base portion is substantially equal to the diameter of the light portion of the conventional low voltage light fixture, and if not, removing at least one ring of a plurality of snapingly-removable, co-planar, concentrically-disposed, generally circular-shaped, and continuous rings of the generally circular-shaped base portion from the generally circular-shaped base portion until the diameter of the centrally-disposed, inwardly-tapering, longitudinally-oriented, and generally circular-shaped throughbore of the generally circular-shaped base portion is substantially equal to the diameter of the light portion of the conventional low voltage light fixture, sliding the low voltage light novelty decoration onto the light portion of the conventional low voltage light fixture with the light portion of the conventional low voltage light fixture entering the centrally-disposed, inwardly-tapering, longitudinally-oriented, and generally circular-shaped throughbore of the generally circular-shaped base portion, and turning the conventional low voltage light fixture on and thereby causing light to emanate from a substantially hollow and decorative main portion of the low voltage light novelty decoration that has a shape, so that the light emanating from the substantially hollow and decorative main portion of the low voltage light novelty decoration causes an optical recognition that associates an specific event with the shape of the substantially hollow and decorative main portion in a mind of a viewer.

YET STILL ANOTHER OBJECT of the present invention is to provide a method of installing a low voltage light novelty decoration onto a conventional low voltage light fixture wherein the second removing step is accomplished by severing at least one groove of a plurality of V-shaped, inwardly-tapering, co-planar, concentrically-disposed, and continuous snap-off grooves of the generally circular-shaped base portion.

STILL YET ANOTHER OBJECT of the present invention is to provide a method of installing a low voltage light novelty decoration onto a conventional low voltage light fixture wherein the second removing step is accomplished by severing snap-off tabs of the generally circular-shaped base portion.

YET STILL ANOTHER OBJECT of the present invention is to provide a method of installing a low voltage light novelty decoration onto a conventional low voltage light fixture that further includes the steps of guiding onto, and maintaining the low voltage light novelty decoration on, the light portion of the conventional low voltage light fixture by virtue of an internal vertical clearance space that extends inwardly from the centrally-disposed, inwardly-tapering, longitudinally-oriented, and generally circular-shaped throughbore of the generally circular-shaped base portion that forms a pocket to receive the light portion of the conventional low voltage light fixture, and by virtue of the tapering of the centrally-disposed, inwardly-tapering, longitudinally-oriented, and generally circular-shaped throughbore of the generally circular-shaped base portion if the diameter of the centrally-disposed, inwardly-tapering, longitudinally-oriented, and generally circular-shaped throughbore of the generally circular-shaped base portion is sufficient and if not sufficient by virtue of a chamfer remaining on an exposed edge of an innermost remaining ring of the plurality of snapingly-removable, co-planar, concentrically-disposed, generally circular-shaped, and continuous rings of the generally circular-shaped base portion that not only facilitates the guidance of the low voltage light novelty decoration onto the light portion of the conventional low voltage light fixture, but also forms a point by virtue of its chamfered configuration that not only deforms to conform to the shape of the light potion of the conventional low voltage light fixture but also concentrates a force exerted by the low voltage light novelty decoration onto the light portion of the conventional low voltage light fixture for increased stability when the low voltage light novelty decoration is installed thereon.

FINALLY, STILL YET ANOTHER OBJECT of the present invention is to provide a method of providing an optical recognition that associates a specific event in a mind of a viewer that includes the step of installing onto a light portion of a conventional low voltage light fixture that has a diameter a low voltage light novelty decoration that includes a substantially hollow and decorative main portion that has a shape, so that the shape of the substantially hollow and decorative main portion identifies the specific event and provides the optical recognition that associates the specific event in the mind of the viewer, a generally circular-shaped base portion that has an exposed outer surface, a substantially concealed inner surface, a center, and a centrally-disposed, inwardly-tapering, longitudinally-oriented, and generally circular-shaped throughbore that passes longitudinally through the center of the generally circular-shaped base portion and which has a diameter wherein the generally circular-shaped base portion is integrally formed with the substantially hollow and decorative main portion, and adjusting apparatus that is associated with the generally circular-shaped base portion for adjusting the diameter of the centrally-disposed, inwardly-tapering, longitudinally-oriented, and generally circular-shaped throughbore of the generally circular-shaped base portion to substantially equal the diameter of the light portion of the conventional low voltage light fixture if the diameter of the centrally-disposed, inwardly-tapering, longitudinally-oriented, and generally circular-shaped throughbore of the generally circular-shaped base portion is not substantially equal to the diameter of the light portion of the conventional low voltage light fixture, so that the centrally-disposed, inwardly-tapering, longitudinally-oriented, and generally circular-shaped throughbore of the generally circular-shaped base portion can be adjusted by the adjusting means of the generally circular-shaped base portion to properly fit on the light portion of the conventional low voltage light fixture when the top cap of the light portion of the conventional low voltage light fixture is removed and replaced by the voltage light novelty decoration.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Preferred Embodiment

Figures 1, 2, 3, 4, 5, 6:
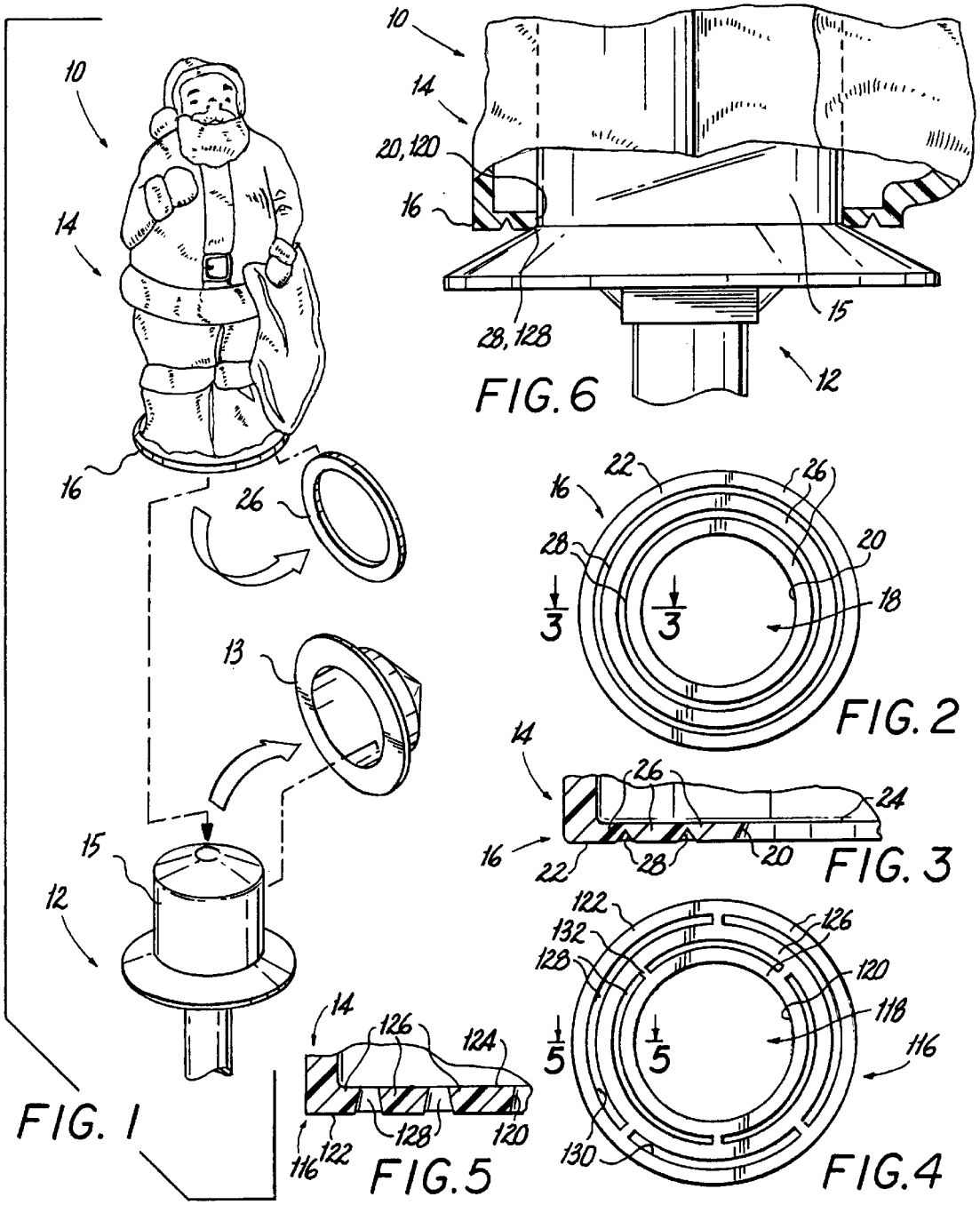
FIG. 1 is an exploded diagrammatic perspective view of the present invention being installed on a conventional low voltage light fixture.
FIG. 2 is a diagrammatic bottom plane view of a preferred embodiment of the base of the present invention.
FIG. 3 is an enlarged cross sectional view taken on line 3—3 in FIG. 2.
FIG. 4 is a diagrammatic bottom plane view of an alternate embodiment of the base of the present invention.
FIG. 5 is an enlarged cross sectional view taken on line 5—5 in FIG. 4.
FIG. 6 is a diagrammatic elevational view, with parts broken away, of the present invention installed on a low voltage light fixture with one ring of the base removed therefrom to accommodate installation thereof.

10 low voltage light novelty decoration of the present invention
12 conventional low voltage light fixture
13 conventional low voltage light fixture removable top cap
14 substantially hollow and decorative main portion
15 conventional low voltage light fixture light portion
16 generally circular-shaped base portion
18 base portion center
20 base portion centrally-disposed, inwardly-tapering, longitudinally-oriented, and generally circular-shaped throughbore
22 base portion exposed outer surface
24 base portion substantially concealed inner surface
26 plurality of base portion snapingly-removable, co-planar, concentrically-disposed, generally circular-shaped, and continuous rings
28 plurality of base portion exposed outer surface V-shaped, inwardly-tapering, co-planar, concentrically-disposed, and continuous snap-off ring grooves

Alternate Embodiment

116 generally circular-shaped base portion
118 base portion center
120 base portion centrally-disposed, inwardly-tapering, longitudinally-oriented, and generally circular-shaped throughbore
122 base portion exposed outer surface
124 base portion substantially concealed inner surface
126 plurality of snapingly-removable, base portion co-planar, concentrically-disposed, generally circular-shaped, and continuous rings
128 plurality of base portion inwardly-tapering, co-planar, concentrically-disposed, and non-continuous throughslots
132 plurality of base portion throughslot arcuate-shaped throughslots
132 base portion snap-off tabs

DETAILED DESCRIPTION OF THE PREFERRED EMBODIMENT

Referring now to the figures in which like numerals indicate like parts, and particularly to FIG. 1, the low voltage light novelty decoration of the present invention is shown generally at 10 being installed on a conventional low voltage light fixture 12 that has a conventional low voltage light fixture removable top cap 13, and a conventional low voltage light fixture light portion 15.

The low voltage light novelty decoration 10 includes a substantially hollow and decorative main portion 14 with a generally circular-shaped base portion 16 that is integrally formed with the substantially hollow and decorative main portion 14.

Discussed infra, is a sample of the different configurations that the substantially hollow and decorative main portion 14 can assume in a height range of preferably approximately 12" to preferably approximately 14". It is to be understood, however, that this sample is for illustrative purposes only and that any configuration can be used for the substantially hollow and decorative main portion 14 that identifies a specific event and provides an optical recognition that associates that specific event in the mind of a viewer, without departing in anyway from the spirit of the present invention.

For Christmas, the substantially hollow and decorative main portion 14 of the low voltage light novelty decoration 10 can be an angel that is preferably approximately 12" high with the base portion 16 thereof being preferably approximately 5.5" in diameter, a snow man that is preferably approximately 14" high with the base portion 16 thereof being preferably approximately 4.5" in diameter, a candle that is preferably approximately 12" high with the base portion 16 thereof being preferably approximately 4.5" in diameter, a candy cane that is preferably approximately 12" high with the base portion 16 thereof being preferably approximately 4.5" in diameter, a star that is preferably approximately 12" high with the base portion 16 thereof being preferably approximately 6.5" in diameter, a cross that is preferably approximately 12" high with the base portion 16 thereof being preferably approximately 4.5" in diameter, a wooden soldier, a Santa Claus, a reindeer, a sled, a tree, or a ginger bread man.

For Independence day, the substantially hollow and decorative main portion 14 of the low voltage light novelty decoration 10 can be a flag, a star-burst, or a wounded trio.

For Halloween, the substantially hollow and decorative main portion 14 of the low voltage light novelty decoration 10 can be a pumpkin, a ghost, a witch, a back cat, or a skull.

For Thanksgiving, the substantially hollow and decorative main portion 14 of the low voltage light novelty decoration 10 can be a turkey, an indian, a boy or girl pilgrim, or an ear of corn.

For Easter, the substantially hollow and decorative main portion 14 of the low voltage light novelty decoration 10 can be an egg, a lamb, a duck, a bunny, a tulip, or a lily.

For vanity items, the substantially hollow and decorative main portion 14 of the low voltage light novelty decoration 10 can be a car, a boat, a plane, or a motorcycle.

For employment items, the substantially hollow and decorative main portion 14 of the low voltage light novelty decoration 10 can be an attorney's book, a CPA's dollar sign, a mechanic's wrench, a plumber's plunger, an electrician's spark, or an engineer's slide rule.

For fraternal organizations, the substantially hollow and decorative main portion 14 of the low voltage light novelty decoration 10 can be the sign of the Elks, the Masons, the K of C, the American Legion, the Rotary, or the Moose.

For birthdays, weddings, baby showers, or for special orders the substantially hollow and decorative main portion 14 of the low voltage light novelty decoration 10 can be configured accordingly.

It is to be understood that the configurations of the substantially hollow and decorative main portion 14 of the low voltage light novelty decoration 10, discussed supra, are significant and of critical importance and must be considered in determining patentability. Support for this assertion can be found in In re Dailey et al., 149 USPQ at 47 (CCPA 1976), where the Court held that the shape of a device must be considered in determining patentability, if the shape is significant:

> " . . . the configuration of the container is a 'mere matter of choice' not significantly novel . . . , [however,] . . . Appellants have provided no argument which convinces us that the particular configuration of their container is significant . . . "[Emphasis added]

The shape of the substantially hollow and decorative main portion 14 of the low voltage light novelty decoration 10 is significant since it identifies a specific event and provides an optical recognition that associates that specific event in the mind of a viewer.

The configuration of the preferred embodiment of the generally circular-shaped base portion 16 of the substantially hollow and decorative main portion 14 can best be seen in FIGS. 2 and 3, and as such will be discussed with reference thereto.

The generally circular-shaped base portion 16 of the substantially hollow and decorative main portion 14 is circular-shaped and has a base portion center 18, a base portion centrally-disposed, inwardly-tapering, longitudinally-oriented, and generally circular-shaped throughbore 20 that passes longitudinally through the base portion center 18 of the generally circular-shaped base portion 16 and has a diameter of preferably approximately 3.25", a base portion exposed outer surface 22, and a base portion substantially concealed inner surface 24.

It is to be understood that the substantially hollow and decorative main portion 14 preferably has 3 inches of internal vertical clearance space extending inwardly from the base portion centrally-disposed, inwardly-tapering, longitudinally-oriented, and generally circular-shaped throughbore 20 of the generally circular-shaped base portion 16 to accommodate installation on the light portion 15 of the conventional low voltage light fixture 12 while assuring stability after installation thereon.

The generally circular-shaped base portion 16 is composed of a plurality of base portion snapingly-removable, co-planar, concentrically-disposed, generally circular-shaped, and continuous rings 26 that can be snapingly removed from each other and from the generally circular-shaped base portion 16, are generally circular shaped, and are co-planar and concentric with each other and with the base portion centrally-disposed, inwardly-tapering, longitudinally-oriented, and generally circular-shaped throughbore 20 of the generally circular-shaped base portion 16.

The innermost ring of the plurality of base portion snapingly-removable, co-planar, concentrically-disposed, generally circular-shaped, and continuous rings 26 of the generally circular-shaped base portion 16 defines the base portion centrally-disposed, inwardly-tapering, longitudinally-oriented, and generally circular-shaped throughbore 20 of the generally circular-shaped base portion 16.

The plurality of base portion snapingly-removable, co-planar, concentrically-disposed, generally circular-shaped, and continuous rings 26 of the generally circular-shaped base portion 16 are formed by a plurality of base portion exposed outer surface V-shaped, inwardly-tapering, co-planar, concentrically-disposed, and continuous snap-off ring grooves 28 that are co-planar and concentric with each other and with the base portion centrally-disposed, inwardly tapering, longitudinally-oriented, and generally circular-shaped throughbore 20 of the generally circular-shaped base portion 16 and with the plurality of base portion snapingly-removable, co-planar, concentrically-disposed, generally circular-shaped, and continuous rings 26, and are preferably formed in the generally circular-shaped base portion 16 by imprinting or embossing.

The plurality of base portion exposed outer surface V-shaped, inwardly-tapering, co-planar, concentrically-disposed, and continuous snap-off grooves 28 of the generally circular-shaped base portion 16 divide the generally circular-shaped base portion 16 into the plurality of base portion snapingly-removable co-planar, concentrically-disposed, generally circular-shaped, and continuous rings 26 of the generally circular-shaped base portion 16, and provide the vehicle for removing at least one ring of the plurality of base portion snapingly-removable, co-planar, concentrically-disposed, generally circular-shaped, and continuous rings 26 of the generally circular-shaped base portion 16 from each other and from the generally circular-shaped base portion 16.

Since the diameter of the base portion centrally-disposed, inwardly tapering, longitudinally-oriented, and generally circular-shaped throughbore 20 of the generally circular-shaped base portion 16 is preferably approximately 3.25" and the rim width of each ring of the plurality of base portion snapingly-removable, co-planar, concentrically-disposed, generally circular-shaped, and continuous rings 26 of the generally circular-shaped base portion 16 is preferably approximately 0.25", by removing the innermost ring of the plurality of base portion snapingly-removable, co-planar, concentrically-disposed, generally circular-shaped, and continuous rings 26 of the generally circular-shaped base portion 16 from the generally circular-shaped base portion 16, the base portion centrally-disposed, inwardly-tapering, longitudinally-oriented, and generally circular-shaped throughbore 20 of the generally circular-shaped base portion 16 is expanded to a diameter of approximately 3.5". By then removing the next ring of the plurality of base portion snapingly-removable, co-planar, concentrically-disposed, generally circular-shaped, and continuous rings 26 of the generally circular-shaped base portion 16, the base portion centrally-disposed, inwardly-tapering, longitudinally-oriented, and generally circular-shaped throughbore 20 of the generally circular-shaped base portion 16 is expanded to a diameter of approximately 3.75", and so on until the diameter of the base portion centrally-disposed, inwardly-tapering, longitudinally-oriented, and generally circular-shaped throughbore 20 of the generally circular-shaped base portion 16 is substantially equal to the diameter of the conventional low voltage light fixture light portion 15 of the conventional low voltage light fixture.

The plurality of base portion exposed outer surface V-shaped, inwardly-tapering, co-planar, concentrically-disposed, and continuous snap-off grooves 28 of the generally circular-shaped base portion 16 taper inwardly from the base portion exposed outer surface 22 of the generally circular-shaped base portion 16 toward the base portion substantially concealed inner surface 24 of the generally circular-shaped base portion 16 to facilitate removing the at least one ring of the plurality of base portion snapingly-removable, co-planar, concentrically-disposed, generally circular-shaped, and continuous rings 26 of the generally circular-shaped base portion 16 from each other and from the generally circular-shaped base portion 16.

Once at least one ring of the plurality of base portion snapingly-removable, co-planar, concentrically-disposed, generally circular-shaped, and continuous rings 26 of the generally circular-shaped base portion 16 has been removed from the generally circular-shaped base portion 16, so that the diameter of the base portion centrally-disposed, inwardly-tapering, longitudinally-oriented, and generally circular-shaped throughbore 20 of the generally circular-shaped base portion 16 is substantially equal to the diameter of the conventional low voltage light fixture light portion of the conventional low voltage light fixture 12, a chamfer remains on the exposed edge of the now innermost ring of the plurality of base portion snapingly-removable, co-planar, concentrically-disposed, generally circular-shaped, and continuous rings 26 of the generally circular-shaped base portion 16 that not only facilitates the guidance of the low voltage light novelty decoration 10 onto the conventional low voltage light fixture light portion 15 of the conventional low voltage light fixture 12, but also forms a point by virtue of its chamfered configuration that not only deforms to conform to the general shape of the conventional low voltage light fixture light portion of the conventional low voltage light fixture 12 but also concentrates the force exerted by the low voltage light novelty decoration 10 onto the conventional low voltage light fixture light portion of the conventional low voltage light fixture 12 for increased stability when it is installed thereon.

It is to be understood, however, that when the diameter of the base portion centrally-disposed, inwardly-tapering, longitudinally-oriented, and generally circular-shaped throughbore 20 of the generally circular-shaped base portion 16 is substantially equal to the diameter of the conventional low voltage light fixture light portion of the conventional low voltage light fixture 12 without having to remove at least one ring of the plurality of base portion snapingly-removable, co-planar, concentrically-disposed, generally circular-shaped, and continuous rings 26 of the generally circular-shaped base portion 16 then the inwardly tapering of the base portion centrally-disposed, inwardly-tapering, longitudinally-oriented, and generally circular-shaped throughbore 20 of the generally circular-shaped base portion 16 accomplishes the same result as the chamfer provided on the exposed edge of the innermost remaining ring of the plurality of base portion snapingly-removable, co-planar, concentrically-disposed, generally circular-shaped, and continuous rings 26 of the generally circular-shaped base portion 16, as discussed supra.

The configuration of an alternate embodiment of the generally circular-shaped base portion 116 of the substantially hollow and decorative main portion 14 can best be seen in FIGS. 4 and 5, and as such will be discussed with reference thereto.

The generally circular-shaped base portion 116 is generally circular-shaped and has a base portion center 118, a base portion centrally-disposed, inwardly-tapering, longitudinally-oriented, and generally circular-shaped throughbore 120 that passes longitudinally through the base portion center 118 of the generally circular-shaped base portion 116 and has a diameter of preferably approximately 3.25", a base portion exposed outer surface 122, and a base portion substantially concealed inner surface 124.

The generally circular-shaped base portion 116 is composed of a plurality of snapingly-removable, base portion co-planar, concentrically-disposed, generally circular-shaped, and continuous rings 126 that can be snapingly removed from each other and from the generally circular-shaped base portion 116, are generally circular shaped, and are co-planar and concentric with each other and with the base portion centrally-disposed, inwardly-tapering, longitudinally-oriented, and generally circular-shaped throughbore 120 of the generally circular-shaped base portion 116.

The innermost ring of the plurality of snapingly-removable, base portion co-planar, concentrically-disposed, generally circular-shaped, and continuous rings 126 of the generally circular-shaped base portion 116 defines the base portion centrally-disposed, inwardly-tapering, longitudinally-oriented, and generally circular-shaped throughbore 120 of the generally circular-shaped base portion 116.

The plurality of base portion snapingly-removable, co-planar, concentrically-disposed, generally circular-shaped, and continuous rings 126 of the generally circular-shaped base portion 116 are formed by a plurality of base portion inwardly-tapering, co-planar, concentrically-disposed, and non-continuous throughslots 128 that are co-planar and concentric with each other and with the base portion centrally-disposed, inwardly-tapering, longitudinally-oriented, and generally circular-shaped throughbore 120 of the generally circular-shaped base portion 116 and with the plurality of base portion snapingly-removable, co-planar, concentrically-disposed, generally circular-shaped, and continuous rings 126.

The plurality of base portion inwardly-tapering, co-planar, concentrically-disposed, generally circular-shaped, and non-continuous throughslots 128 of the generally circular-shaped base portion 116 divide the generally circular-shaped base portion 116 into the plurality of base portion snapingly-removable, co-planar, concentrically-disposed, generally circular-shaped, and continuous rings 126 of the generally circular-shaped base portion 16.

Each non-continuous throughslot of the plurality of base portion inwardly-tapering, co-planar, concentrically-disposed, and non-continuous throughslots 128 of the generally circular-shaped base portion 116 is divided into a plurality of base portion throughslot arcuate-shaped throughslots 130 by base portion snap-off tabs 132 which not only divide each non-continuous throughslot of the plurality of base portion inwardly-tapering, co-planar, concentrically-disposed, and non-continuous throughslots 128 of the generally circular-shaped base portion 116 into the plurality of base portion throughslot arcuate-shaped throughslots 130 of each non-continuous throughslot of the plurality of base portion inwardly-tapering, co-planar, concentrically-disposed, and non-continuous throughslots 128 of the generally circular-shaped base portion 116, but also provide the vehicle for removing at least one of the plurality of base portion snapingly-removable, co-planar, concentrically-disposed, generally circular-shaped, and continuous rings 126 from each other and from the generally circular-shaped base portion 116.

The base portion snap-off tabs 132 of the generally circular-shaped base portion 116 of one throughslot of the plurality of base portion inwardly-tapering, co-planar, concentrically-disposed, generally circular-shaped, and non-continuous throughslots 128 of the generally circular-shaped base portion 116 are staggered relative to the base portion snap-off tabs 132 of the generally circular-shaped base portion 116 of an adjacent throughslot of the plurality of base portion inwardly-tapering, co-planar, concentrically-disposed, generally circular-shaped, and non-continuous throughslots 128 of the generally circular-shaped base portion 116, so that more rigidity is provided to the generally circular-shaped base portion 116.

Since the diameter of the base portion centrally-disposed, inwardly tapering, longitudinally-oriented, and generally circular-shaped throughbore 120 of the generally circular-shaped base portion 116 is preferably approximately 3.25" and the rim width of each ring of the plurality of base portion snapingly-removable, co-planar, concentrically-disposed, generally circular-shaped, and continuous rings 126 of the generally circular-shaped base portion 116 is preferably approximately 0.25", by removing the innermost ring of the plurality of base portion snapingly-removable, co-planar, concentrically-disposed, generally circular-shaped, and continuous rings 126 of the generally circular-shaped base portion 116 from the generally circular-shaped base portion 116, the base portion centrally-disposed, inwardly-tapering, longitudinally-oriented, and generally circular-shaped throughbore 120 of the generally circular-shaped base portion 116 is expanded to a diameter of approximately 3.5". By then removing the next ring of the plurality of base portion snapingly-removable, co-planar, concentrically-disposed, generally circular-shaped, and continuous rings 126 of the generally circular-shaped base portion 116, the base portion centrally-disposed, inwardly-tapering, longitudinally-oriented, and generally circular-shaped throughbore 120 of the generally circular-shaped base portion 116 expands to a diameter of approximately 3.75", and so on until the diameter of the base portion centrally-disposed, inwardly-tapering, longitudinally-oriented, and generally circular-shaped throughbore 120 of the generally circular-shaped base portion 116 is substantially equal to the diameter of the conventional low voltage light fixture light portion 15 of the conventional low voltage light fixture.

The plurality of base portion inwardly-tapering, co-planar, concentrically-disposed, and non-continuous throughslots 128 of the generally circular-shaped base portion 116 taper inwardly from the base portion exposed outer surface 122 of the generally circular-shaped base portion 116 toward the base portion substantially concealed inner surface 124 of the generally circular-shaped base portion 116.

Once the at least one ring of the plurality of base portion snapingly-removable, co-planar, concentrically-disposed, generally circular-shaped, and continuous rings 126 of the generally circular-shaped base portion 116 has been removed from the generally circular-shaped base portion 116, so that the diameter of the base portion centrally-disposed, inwardly-tapering, longitudinally-oriented, and generally circular-shaped throughbore 120 of the generally circular-shaped base portion 116 is substantially equal to the diameter of the conventional low voltage light fixture light portion 15 of the conventional low voltage light fixture 12, a chamfer remains on the exposed edge of the now innermost ring of the plurality of base portion snapingly-removable, co-planar, concentrically-disposed, generally circular-shaped, and continuous rings 126 of the generally circular-shaped base portion 116 that not only facilitates the guidance of the low voltage light novelty decoration 10 onto the conventional low voltage light fixture light portion 15 of the conventional low voltage light fixture 12, but also forms a point by virtue of its chamfered configuration that not only deforms to conform to the general shape of the conventional low voltage light fixture light portion 15 of the conventional low voltage light fixture 12 but also concentrates the force exerted by the low voltage light novelty decoration 10 onto the conventional low voltage light fixture light portion 15 of the conventional low voltage light fixture 12 for increased stability when it is installed thereon.

The low voltage light novelty decoration 10 can be packaged in a box with instructions and storage capabilities, and possibly marketed in predetermined groups.

The manner of installing the low voltage light novelty decoration 10 onto the conventional low voltage light fixture 12 can best be seen in FIGS. 1 and 6, and as such will be discussed with reference thereto.

The conventional low voltage light fixture removable top cap 13 of the conventional low voltage light fixture 12 is removed from the conventional low voltage light fixture light portion 15 of the conventional low voltage light fixture 12.

If the diameter of the centrally-disposed, inwardly-tapering, longitudinally-oriented, and generally circular-shaped throughbore 20 of the generally circular-shaped base portion 16 is not substantially equal to the diameter of the conventional low voltage light fixture light portion of the conventional low voltage light fixture 12, at least one ring of the plurality of base portion snapingly-removable, co-planar, concentrically-disposed, generally circular-shaped, and continuous rings 26, 126 of the generally circular-shaped base portion 16, 116 is removed from the generally circular-shaped base portion 16, 116, by severing either the respective groove of the plurality of base portion exposed outer surface V-shaped, inwardly-tapering, co-planar, concentrically-disposed, and continuous snap-off grooves 28 of the generally circular-shaped base portion 16 or by severing the appropriate tabs of the base portion snap-off tabs 132 of the generally circular-shaped base portion 116 depending upon which embodiment is being used until the diameter of the base portion centrally-disposed, inwardly-tapering, longitudinally-oriented, and generally circular-shaped throughbore 20, 120 of the generally circular-shaped base portion 16, 116 is substantially equal to the diameter of the conventional low voltage light fixture light portion 15 of the conventional low voltage light fixture 12.

The low voltage light novelty decoration 10 is slid onto the conventional low voltage light fixture light portion 15 of the conventional low voltage light fixture 12 with the conventional low voltage light fixture 12 entering the base portion centrally-disposed, inwardly-tapering, longitudinally-oriented, and generally circular-shaped throughbore 20, 120 of the generally circular-shaped base portion 16, 116.

The low voltage light novelty decoration 10 remains stable on the conventional low voltage light fixture light portion 15 of the conventional low voltage light fixture 12 by virtue of a number of reasons.

The preferably 3 inches of internal vertical clearance space that extends inwardly from the base portion centrally-disposed, inwardly-tapering, longitudinally-oriented, and generally circular-shaped throughbore 20 of the generally circular-shaped base portion 16 forms a pocket to receive the conventional low voltage light fixture light portion 15 of the conventional low voltage light fixture 12, and the tapering of the base portion centrally-disposed, inwardly-tapering, longitudinally-oriented, and generally circular-shaped throughbore 20, 120 of the generally circular-shaped base portion 16, 116 if the diameter of the base portion centrally-disposed, inwardly-tapering, longitudinally-oriented, and generally circular-shaped throughbore 20, 120 of the generally circular-shaped base portion 16, 116 is sufficient, or the chamfer remaining on the exposed edge of the now innermost ring of the plurality of base portion snapingly-removable, co-planar, concentrically-disposed, generally circular-shaped, and continuous rings 26, 126 of the generally circular-shaped base portion 16, 116 if the diameter of the base portion centrally-disposed, inwardly tapering, longitudinally-oriented, and generally circular-shaped throughbore 20, 120 of the generally circular-shaped base portion 16, 116 is insufficient, as discussed supra.

The conventional low voltage light fixture 12 is turned on causing light to emanate from the substantially hollow and decorative main portion 14 of the low voltage light novelty decoration 10. The light emanating from the substantially hollow and decorative main portion 14 of the low voltage light novelty decoration 10 causes an optical recognition that associates the specific event associated with the shape of the substantially hollow and decorative main portion 14 of the low voltage light novelty decoration 10 in the mind of a viewer.

It will be understood that each of the elements described above, or two or more together, may also find a useful application in other types of constructions differing from the types described above.

While the invention has been illustrated and described as embodied in a low voltage light novelty decoration, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A low voltage light novelty decoration being installable on a conventional low voltage light fixture having a light portion with a diameter, a shape, and a removable top cap, comprising:

a) a substantially hollow and decorative main portion having a shape, so that said shape of said substantially hollow and decorative main portion identifies a specific event and provides an optical recognition that associates the specific event in a mind of a viewer;

b) a generally circular-shaped base portion having an exposed outer surface, a substantially concealed inner surface, a center, and a centrally-disposed, inwardly-tapering, longitudinally-oriented, and generally circular-shaped throughbore passing longitudinally through said center of said generally circular-shaped base portion and having a diameter; said generally circular-shaped base portion being integrally formed with said substantially hollow and decorative main portion; and c) adjusting means associated with said generally circular-shaped base portion for adjusting said diameter of said centrally-disposed, inwardly-tapering, longitudinally-oriented, and generally circular-shaped throughbore of said generally circular-shaped base portion to substantially equal the diameter of the light portion of the conventional low voltage light fixture if the diameter of said centrally-disposed, inwardly-tapering, longitudinally-oriented, and generally circular-shaped throughbore of said generally circular-shaped base portion is not substantially equal to the diameter of the light portion of the conventional low voltage light fixture, so that said centrally-disposed, inwardly-tapering, longitudinally-oriented, and generally circular-shaped throughbore of said generally circular-shaped base portion can be adjusted by said adjusting means of said generally circular-shaped base portion to properly fit on the light portion of the conventional low voltage light fixture when the top cap of the light portion of the conventional low voltage light fixture is removed and replaced by said voltage light novelty decoration; said adjusting means including a plurality of snapingly-removable, co-planar, concentrically-disposed, generally circular-shaped, and continuous rings being snapingly removed from each other and from said generally circular-shaped base portion, being generally circular shaped, and being co-planar and concentric with each other and with said centrally-disposed, inwardly-tapering, longitudinally-oriented, and generally circular-shaped throughbore of said generally circular-shaped base portion; an innermost remaining ring of said plurality of base portion snapingly-removable, co-planar, concentrically-disposed, generally circular-shaped, and continuous rings of said generally circular-shaped base portion defining said centrally-disposed, inwardly-tapering, longitudinally-oriented, and generally circular-shaped throughbore of said generally circular-shaped base portion.

2. The decoration as defined in claim 1, wherein said substantially hollow and decorative main portion has an internal vertical clearance space that opens into, and extends inwardly from, said centrally-disposed, inwardly-tapering, longitudinally-oriented, and generally circular-shaped throughbore of said generally circular-shaped base portion, so that said low voltage light novelty decoration is accommodated installation on the light portion of the conventional low voltage light fixture while assuring stability after installation thereof.

3. The decoration as defined in claim 1, wherein said plurality of snapingly-removable, co-planar, concentrically-disposed, generally circular-shaped, and continuous rings of said generally circular-shaped base portion are formed by a plurality of V-shaped, inwardly-tapering, co-planar, concentrically-disposed, and continuous snap-off ring grooves that are co-planar and concentric with each other and with said centrally-disposed, inwardly tapering, longitudinally-oriented, and generally circular-shaped throughbore of said generally circular-shaped base portion and with said plurality of snapingly-removable, co-planar, concentrically-disposed, generally circular-shaped, and continuous rings; said plurality of V-shaped, inwardly-tapering, co-planar, concentrically-disposed, and continuous snap-off grooves of said generally circular-shaped base portion divide said generally circular-shaped base portion into said plurality of snapingly-removable co-planar, concentrically-disposed, generally circular-shaped, and continuous rings of said generally circular-shaped base portion, and provide a vehicle for removing at least one ring of said plurality of snapingly-removable, co-planar, concentrically-disposed, generally circular-shaped, and continuous rings of said generally circular-shaped base portion from each other and from said generally circular-shaped base portion, so that at least one ring of said plurality of snapingly-removable, co-planar, concentrically-disposed, generally circular-shaped, and continuous rings of said generally circular-shaped base portion can be removed until said diameter of said centrally-disposed, inwardly-tapering, longitudinally-oriented, and generally circular-shaped throughbore of said generally circular-shaped base portion substantially equals the diameter of the light portion of the conventional low voltage light fixture.

4. The decoration as defined in claim 3, wherein said plurality of V-shaped, inwardly-tapering, co-planar, concentrically-disposed, and continuous snap-off ring grooves of said generally circular-shaped base portion is produced my means selected from the group consisting of imprinting and embossing.

5. The decoration as defined in claim 3, wherein said plurality of V-shaped, inwardly-tapering, co-planar, concentrically-disposed, and continuous snap-off grooves of said generally circular-shaped base portion taper inwardly from said exposed outer surface of said generally circular-shaped base portion toward said substantially concealed inner surface of said generally circular-shaped base portion, so that removing said at least one ring of said plurality of base portion snapingly-removable, co-planar, concentrically-disposed, generally circular-shaped, and continuous rings of said generally circular-shaped base portion from each other and from said generally circular-shaped base portion provides a chamfer on an exposed edge of said innermost remaining ring of said plurality of snapingly-removable, co-planar, concentrically-disposed, generally circular-shaped, and continuous rings of said generally circular-shaped base portion that not only facilitates guidance of said low voltage light novelty decoration onto the light portion of the conventional low voltage light fixture but also forms a point by virtue of its chamfered configuration that not only deforms to conform to the shape of the light portion of the conventional low voltage light fixture but also concentrates force exerted by said low voltage light novelty decoration onto the light portion of the conventional low voltage light fixture for increased stability when said low voltage light novelty decoration is installed thereon.

6. The decoration as defined in claim 1, wherein said plurality of snapingly-removable, co-planar, concentrically-disposed, generally circular-shaped, and continuous rings of said generally circular-shaped base portion are formed by a plurality of inwardly-tapering, co-planar, concentrically-disposed, and non-continuous throughslots that are co-planar and concentric with each other and with said centrally-disposed, inwardly-tapering, longitudinally-oriented, and generally circular-shaped throughbore of said generally circular-shaped base portion and with said plurality of snapingly-removable, co-planar, concentrically-disposed, generally circular-shaped, and continuous rings; said plurality of inwardly-tapering, co-planar, concentrically-disposed, generally circular-shaped, and non-continuous throughslots of said generally circular-shaped base portion divide said generally circular-shaped base portion into said plurality of snapingly-removable, co-planar, concentrically-disposed, generally circular-shaped, and continuous rings of said generally circular-shaped base portion.

7. The decorations defined in claim 6, wherein said plurality of inwardly-tapering, co-planar, concentrically-disposed, and non-continuous throughslots of said generally circular-shaped base portion taper inwardly from said exposed outer surface of said generally circular-shaped base portion toward said substantially concealed inner surface of said generally circular-shaped base portion, so that removing said at least one ring of said plurality of base portion snapingly-removable, co-planar, concentrically-disposed, generally circular-shaped, and continuous rings of said generally circular-shaped base portion from each other and from said generally circular-shaped base portion provides a chamfer on an exposed edge of said innermost remaining ring of said plurality of snapingly-removable, co-planar, concentrically-disposed, generally circular-shaped, and continuous rings of said generally circular-shaped base portion that not only facilitates guidance of said low voltage light novelty decoration onto the light portion of the conventional low voltage light fixture but also forms a point by virtue of its chamfered configuration that not only deforms to conform to the shape of the light portion of the conventional low voltage light fixture but also concentrates force exerted by said low voltage light novelty decoration onto the light portion of the conventional low voltage light fixture for increased stability when said low voltage light novelty decoration is installed thereon.

8. The decoration as defined in claim 6, wherein each non-continuous throughslot of said plurality of inwardly-tapering, co-planar, concentrically-disposed, and non-continuous throughslots of said generally circular-shaped base portion is divided into a plurality of arcuate-shaped throughslots by snap-off tabs which not only divide each non-continuous throughslot of said plurality of inwardly-tapering, co-planar, concentrically-disposed, and non-continuous throughslots of said generally circular-shaped base portion into said plurality of arcuate-shaped throughslots of each non-continuous throughslot of said plurality of inwardly-tapering, co-planar, concentrically-disposed, and non-continuous throughslots of said generally circular-shaped base portion, but also provide a vehicle for removing said at least one ring of said plurality of snapingly-removable, co-planar, concentrically-disposed, generally circular-shaped, and continuous rings from each other and from said generally circular-shaped base portion, so that at least one ring of said plurality of snapingly-removable, co-planar, concentrically-disposed, generally circular-shaped, and continuous rings of said generally circular-shaped base portion can be removed until said diameter of said centrally-disposed, inwardly-tapering, longitudinally-oriented, and generally circular-shaped throughbore of said generally circular-shaped base portion substantially equals the diameter of the light portion of the conventional low voltage light fixture.

9. The decoration as defined in claim 8, wherein said snap-off tabs of said generally circular-shaped base portion of each throughslot of said plurality of inwardly-tapering, co-planar, concentrically-disposed, generally circular-shaped, and non-continuous throughslots of said generally circular-shaped base portion are staggered relative to said snap-off tabs of said generally circular-shaped base portion of an adjacent throughslot of said plurality of inwardly-tapering, co-planar, concentrically-disposed, generally circular-shaped, and non-continuous throughslots of said generally circular-shaped base portion, so that more rigidity is provided to said generally circular-shaped base portion.

* * * * *